US006491200B1

(12) United States Patent
McCarthy

(10) Patent No.: US 6,491,200 B1
(45) Date of Patent: Dec. 10, 2002

(54) NEEDLE FOR USE IN A PLASTIC FASTENER DISPENSING TOOL

(75) Inventor: Francis T. McCarthy, Lowell, MA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/642,317

(22) Filed: Aug. 21, 2000

(51) Int. Cl.[7] ..... B65C 7/00
(52) U.S. Cl. ..... 227/67
(58) Field of Search ..... 227/67, 68, 71, 227/119

(56) References Cited

U.S. PATENT DOCUMENTS

| | | | | |
|---|---|---|---|---|
| 3,895,753 A | | 7/1975 | Bone | |
| 4,273,279 A | * | 6/1981 | Kunreuther | 227/67 |
| 4,333,596 A | | 6/1982 | Kunreuther | |
| 4,611,740 A | | 9/1986 | Kunreuther | |
| 5,669,543 A | | 9/1997 | Ueno | |
| 5,715,984 A | | 2/1998 | Deschenes | |

* cited by examiner

*Primary Examiner*—Scott A. Smith
(74) *Attorney, Agent, or Firm*—Kriegsman & Kriegsman

(57) ABSTRACT

Needle for use in a plastic fastener dispensing tool. In one embodiment, the needle is a two-piece structure including a stem and a base. The stem, which is made from stamped and rolled metal, has a front portion and a rear portion. The front portion is generally cylindrical in shape and has a longitudinal bore adapted to receive a cross-bar, a longitudinal slot adapted to permit a filament to pass therethrough while a cross-bar is seated in the bore, and a tip adapted for insertion into an article. The rear portion of the stem is provided with an asymmetric V-shaped cutting notch along its rear edge for use in severing the severable connector between a fastener and its runner bar. The notch has an internal angle of approximately 110° and a width of approximately 0.050–0.055 inch. The vertex of the notch is positioned at the centerline of the bore. The base, which is made of molded plastic, is mounted onto the rear portion of the stem. The base includes a longitudinal bore, a longitudinal slot, a lateral slot and a recess. The bore of the base is aligned with the bore of the stem and is similarly adapted to receive the cross-bar of a plastic fastener. The slot of the base is aligned with the slot of the stem and is similarly adapted to permit the flexible filament of a fastener to pass therethrough while the cross-bar is seated in the bore. The lateral slot is used to permit a cross-bar to be loaded into the base from the side of the base. The recess is adapted to accommodate a needle locking shaft of a plastic fastener dispensing tool. The base is also provided with a cutout at the rear end thereof that is in alignment with the notch of the stem and which serves to prevent the base from interfering with the operation of the notch.

21 Claims, 6 Drawing Sheets

NEEDLE FOR USE IN A PLASTIC FASTENER DISPENSING TOOL

BACKGROUND OF THE INVENTION

The present invention relates generally to plastic fasteners and more particularly to a needle for use in a plastic fastener dispensing tool.

Plastic fasteners of the type comprising an elongated flexible filament having a first cross-bar at one end and a second cross-bar (or other enlargement, such as a paddle or a knob) at the opposite end are well-known and have been widely used in a variety of applications, such as in the attachment of merchandise tags to articles of commerce, in the attachment of buttons to garments, in the lasting of shoes, and in various packaging applications. Typically, such plastic fasteners are mass-produced by molding processes into either one of two different types of assemblies. One such assembly, an example of which is disclosed in U.S. Pat. No. 3,103,666, inventor Bone, issued Sep. 17, 1963 (which patent is incorporated herein by reference), is a clip-type assembly, said clip comprising a plurality of fasteners, each such fastener comprising a flexible filament having a first cross-bar at one end thereof and a paddle or second cross-bar at the opposite end thereof. The fasteners are arranged in a spaced, side-by-side orientation, with the respective first cross-bars parallel to one another and the respective paddles or second cross-bars parallel to one another, each of the first cross-bars being joined to a common, orthogonally-disposed runner bar by a severable connector. Adjacent second cross-bars or paddles also may be interconnected by severable connectors extending therebetween.

The aforementioned fastener clip is typically made by injection molding. Several commercial embodiments of the above-described fastener clip have been sold by the present assignee, Avery Dennison Corporation, as DENNISION® SWIFTACH® fastener clips.

Tools (often referred to as "tagging guns" or "fastener attaching tools") for dispensing individual fasteners from fastener clips of the type described above are known, examples of such tools being disclosed in the following U.S. patents, all of which are incorporated herein by reference: U.S. Pat. No. 3,895,753, inventor Bone, issued Jul. 22, 1975; U.S. Pat. No. 4,611,740, inventor Kunreuther, issued Sep. 16, 1986; and U.S. Pat. No. 3,893,612, inventor Bone, issued Jul. 8, 1975.

Such tools typically comprise a needle, the needle typically including a stem and a base. The stem, which is typically made from stamped and rolled metal, typically has a front portion and a rear portion. The front portion is generally cylindrical in shape and has a longitudinally-extending, cylindrically-shaped bore adapted to receive the first cross-bar of a fastener. In addition, the front portion of said stem also typically has a longitudinally-extending slot adapted to permit the filament portion of a fastener to extend therethrough while the first cross-bar of the fastener is disposed in the longitudinal bore. The front portion of the stem also typically terminates at its front end in a tip adapted for insertion into a desired article of commerce. The rear portion of the stem is typically shaped to include a cutting element or knife along its rear edge for cutting the severable connector connecting the runner bar to the cross-bar as the cross-bar is being loaded into the longitudinal bore. Typically, said knife is in the form of a V-shaped notch having an internal angle of about 75 degrees and a width of about 0.025 inch.

The base of the needle is typically made of molded plastic and is mounted onto the rear portion of the stem. The base is typically a generally cylindrical member having a longitudinal bore aligned with the longitudinal bore of the stem and having a longitudinal slot aligned with the longitudinal slot of the stem. The base also typically has a lateral slot adapted to permit part of the cross-bar to be fed into the base from the side and also includes a recess formed on the outer surface of the base adapted to engage a locking mechanism in a tool. The base also typically has a cutout at the rear end thereof that is in alignment with the notch of the stem and which serves to prevent the base from interfering with the operation of the notch.

Although the above-described needle is a two-part structure, corresponding needles have also been formed as unitary structures machined from a single piece of metal.

Examples of the needles described above are disclosed in the following patents, all of which are incorporated herein by reference: U.S. Pat. No. 4,333,596, inventor Kunreuther, issued Jun. 8, 1982; U.S. Pat. No. 4,611,740, inventor Kunreuther, issued Sep. 16, 1986; and U.S. Pat. No. 3,895,753, inventor Bone, issued Jul. 22, 1975.

One problem that has been noted by the present inventor with respect to the dispensing of individual fasteners from fastener clips of the type described above using needles of the types described above is that there is occasionally some difficulty in properly aligning the severable connector with the cutting notch on the needle. In these instances, the connector is often advanced in a tool past the cutting notch, thereby resulting in considerably higher cutting resistance and, as a result, in jamming of the tool.

One approach to the aforementioned problem is disclosed in U.S. Pat. No. 5,715,984, inventor Deschenes, which issued Feb. 10, 1998, and which is incorporated herein by reference. In said patent, there is described a needle for use as part of a fastener dispensing tool, said needle comprising a substantially cylindrical base portion having a front end, a rear end, a side surface, a central bore, and a longitudinal slot. The needle also includes a stem portion extending out from the front end of the base portion. The stem portion is a substantially cylindrically shaped member which comprises a sharp tip, a longitudinal slot in alignment with the longitudinal slot in the base portion, and a central bore in alignment with the central bore in the base portion. The needle further includes a knife portion on the rear end of the base portion. The knife portion has a pair of side edges and a back edge, the back edge including a cutting edge in the form of a notch, said notch extending across the entire length of the back edge from one side edge to the other side edge.

SUMMARY OF THE INVENTION

It is an object of the present invention to provide a novel needle for use in a plastic fastener dispensing tool.

It is another object of the present invention to provide a needle as described above that overcomes at least some of the disadvantages discussed above in connection with certain existing needles.

It is still another object of the present invention to provide a needle as described above that can be mass produced and that can be used in conventional plastic fastener dispensing tools.

According to one feature of the invention, there is provided a needle for use in a plastic fastener dispensing tool, said needle comprising (a) a stem, said stem being elongated and having a front portion and a rear portion, said front portion being shaped to include a slotted longitudinal bore terminating in a tip at its front end, said rear portion having a knife implement in the form of a notch at its rear end, said notch being asymmetric about the longitudinal axis of said slotted longitudinal bore; and (b) a base, said base being mounted onto said rear portion of said stem, said base being shaped to include a slotted longitudinal bore aligned with said slotted longitudinal bore of said stem.

According to another feature of the invention, there is provided a needle for use in a plastic fastener dispensing tool, said needle comprising (a) a stem, said stem being elongated and having a front portion and a rear portion, said front portion being shaped to include a slotted longitudinal bore terminating in a tip at its front end, said rear portion having a rear end, said rear end being shaped to include a knife implement in the form a notch, said notch extending only partially across said rear end, said notch having an internal angle of approximately 110–145 degrees; and (b) a base, said base being mounted onto said rear portion of said stem, said base being shaped to include a slotted longitudinal bore aligned with said slotted longitudinal bore of said stem.

According to still another feature of the invention, there is provided a needle for use in a plastic fastener dispensing tool, said needle comprising (a) a stem, said stem being elongated and having a front portion and a rear portion, said front portion being shaped to include a slotted longitudinal bore terminating in a tip at its front end, said rear portion having a rear end, said rear end being shaped to include a knife implement in the form of a notch, said notch having a width of approximately 0.050–0.08 inch; and (b) a base, said base being mounted onto said rear portion of said stem, said base being shaped to include a slotted longitudinal bore aligned with said slotted longitudinal bore of said stem.

According to still yet another feature of the invention, there is provided a needle for use in a plastic fastener dispensing tool, said needle comprising (a) a base portion, said base portion having a front end, a rear end, and a slotted longitudinal bore; (b) a stem portion extending out from the front end of said base portion, said stem portion having a slotted longitudinal bore aligned with the slotted longitudinal bore in said base portion; and (c) a knife portion on said base portion, said knife portion having a pair of side edges and a back edge, the back edge including a cutting implement in the form of a notch; (d) wherein said notch is asymmetric about the longitudinal axis of said slotted longitudinal bore of said stem portion.

According to even yet another feature of the invention, there is provided a needle for use in a plastic fastener dispensing tool, said needle comprising (a) a base portion, said base portion having a front end, a rear end, and a slotted longitudinal bore; (b) a stem portion extending out from the front end of said base portion, said stem portion having a slotted longitudinal bore aligned with the slotted longitudinal bore in said base portion; and (c) a knife portion on said base portion, said knife portion having a pair of side edges and a back edge, the back edge including a cutting implement in the form of a notch; (d) wherein said notch extends only partially across said back edge from one side edge to the other side edge, said notch having an internal angle of about 110–145 degrees.

According to a further feature of the invention, there is provided a needle for use in a plastic fastener dispensing tool, said needle comprising (a) a base portion, said base portion having a front end, a rear end, and a slotted longitudinal bore; (b) a stem portion extending out from the front end of said base portion, said stem portion having a slotted longitudinal bore aligned with the slotted longitudinal bore in said base portion; and (c) a knife portion on said base portion, said knife portion having a pair of side edges and a back edge, the back edge including a cutting implement in the form of a notch; (d) wherein said notch extends only partially across said back edge from one side edge to the other side edge and has a width of about 0.50–0.08 inch.

According to still a further feature of the invention, there is provided a needle for use in a plastic fastener dispensing tool, said needle comprising (a) a base portion, said base portion having a front end, a rear end, and a slotted longitudinal bore; (b) a stem portion extending out from the front end of said base portion, said stem portion having a slotted longitudinal bore aligned with the slotted longitudinal bore in said base portion; and (c) a knife formed in the rear end of said base portion, said knife being in the form of a notch; (d) wherein said notch is asymmetric about the longitudinal axis of said slotted longitudinal bore of said stem portion.

According to still yet a further feature of the invention, there is provided a needle for use in a plastic fastener dispensing tool, said needle comprising (a) a base portion, said base portion having a front end, a rear end, and a slotted longitudinal bore; (b) a stem portion extending out from the front end of said base portion, said stem portion having a slotted longitudinal bore aligned with the slotted longitudinal bore in said base portion; and (c) a knife formed in the rear end of said base portion, said knife being in the form of a notch; (d) wherein said notch extends only partially across said rear end, said notch having an internal angle of about 110–145 degrees.

According to still even yet a further feature of the invention, there is provided a needle for use in a plastic fastener dispensing tool, said needle comprising (a) a base portion, said base portion having a front end, a rear end, and a slotted longitudinal bore; (b) a stem portion extending out from the front end of said base portion, said stem portion having a slotted longitudinal bore aligned with the slotted longitudinal bore in said base portion; and (c) a knife formed in the rear end on said base portion, said knife being in the form of a notch; (d) wherein said notch extends only partially across said rear end and has a width of about 0.50–0.08 inch.

Additional objects, features, aspects and advantages of the present invention will be set forth, in part, in the description which follows and, in part, will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute apart of this specification, illustrate preferred embodiments of the invention and, together with the description, serve to explain the principles of the invention. In the drawings wherein like reference numerals represent like parts.

DETAILED DESCRIPTION OF PREFERRED EMBODIMENTS

Figure 1:
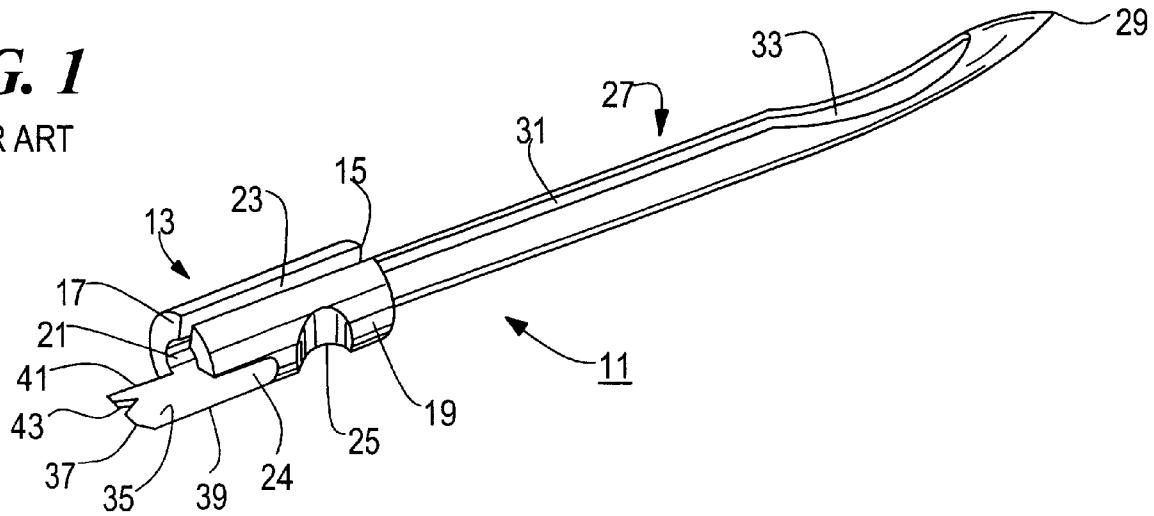
FIG. 1 PRIOR ART
FIG. 1 is a perspective view of a first conventional needle adapted for use in a plastic fastener dispensing tool.
Figure 2:
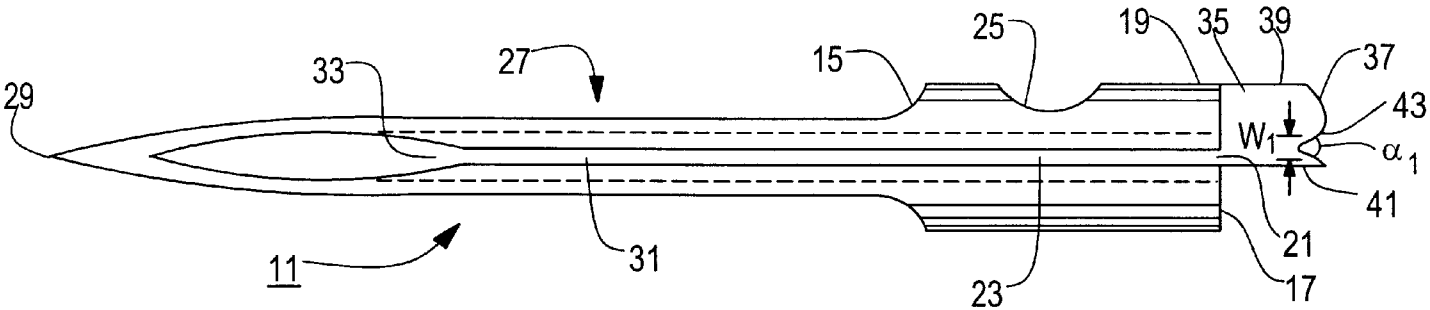
FIG. 2 PRIOR ART
FIG. 2 is a top view of the conventional needle of FIG. 1.

Referring now to FIGS. 1 and 2, there are shown perspective and top views, respectively, of a first conventional needle of the type commonly used in plastic fastener dispensing tools, said needle being represented generally by reference numeral 11.

Needle 11, which is a unitary structure machined from a single piece of metal (e.g., steel), comprises a substantially cylindrical base portion 13, base portion 13 having a front end 15, a rear end 17, and a side surface 19. A longitudinally-extending central bore 21 is formed in base portion 13 for receiving the cross-bar of a plastic fastener. A longitudinal slot 23 and a lateral slot 24 are also formed in base portion 13. Longitudinal slot 23 is used to permit the flexible filament of a fastener to pass therethrough while the cross-bar attached to the filament is seated in bore 21. Lateral slot 24 is used to permit a cross-bar to be loaded into base portion 13 from the side of base portion 13. A recess 25 is provided on side surface 19 for accommodating a needle locking shaft (not shown) of a plastic fastener dispensing tool.

Needle 11 additionally comprises a stem portion 27, stem portion 27 extending out from front end 15 of base portion 13. Stem portion 27 is a substantially cylindrically shaped member comprising a tip 29 adapted for insertion into an article of commerce, a longitudinal slot 31 in alignment with longitudinal slot 23 of base portion, and a longitudinal bore 33 in alignment with bore 21 of base portion 13.

Needle 11 further comprises a substantially planar knife portion 35, knife portion 35 extending rearwardly from base portion 13, preferably from rear end 17. Knife portion 35 includes a rear edge 37 and a pair of side edges 39 and 41. A symmetric "V"-shaped cutting element or notch 43 is provided within a portion of rear edge 37, notch 43 being adapted to receive the severable connector extending between a fastener and its associated runner bar and to sever said connector as the cross-bar of the fastener is pushed through needle 11. Notch 43 has an internal angle $\alpha_1$ of approximately 75° and a width $w_1$ of approximately 0.025 inch.

As discussed above, it has been found, on occasion, that the severable connector interconnecting the cross-bar of a fastener and its associated runner bar is not properly aligned with notch 43 and, instead, is positioned against an adjacent portion of rear edge 37 or against side edges 39 or 41. (In most instances where the connector is not aligned with notch 43, it has been advanced past notch 43 to the far end of rear edge 37 or to side edge 41.) As a result, the severable connector will often fail to be cut, causing the fastener to be attached to its runner bar during displacement of the cross-bar through bores 21 and 33. This results in a jamming of the fastener within needle 11, rendering it inoperable.

Figure 3:
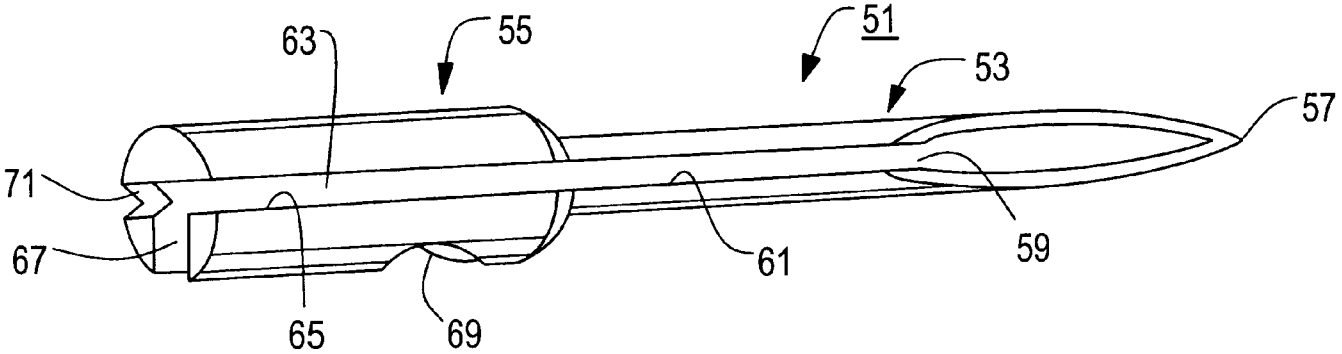
FIG. 3 PRIOR ART
FIG. 3 is a top perspective view of a second conventional needle adapted for use in a plastic fastener dispensing tool.
Figure 4:
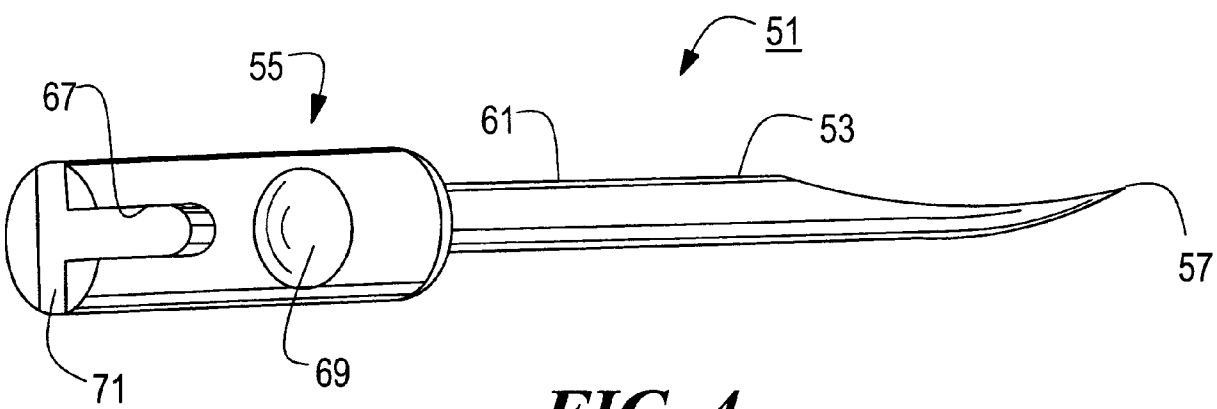
FIG. 4 PRIOR ART
FIG. 4 is a side perspective view of the conventional needle of FIG. 3.

Referring now to FIGS. 3 and 4, there are shown top and side perspective views, respectively, of a second conventional needle adapted for use in a plastic fastener dispensing tool, said needle being represented generally by reference numeral 51.

Needle 51, which is also a unitary structure machined from a single piece of metal (e.g., steel), comprises an elongated shank portion 53 and a generally cylindrical base portion 55. Shank portion 53, like stem portion 27, is generally cylindrical and comprises a tip 57 adapted for insertion into an article of commerce, a longitudinal bore 59 adapted to receive a cross-bar of a fastener, and a longitudinal slot 61 in communication with bore 59 and adapted to permit a filament of a fastener to pass therethrough when its associated cross-bar is seated in bore 59.

Base portion 55, like base portion 13, includes a longitudinal bore 63, a longitudinal slot 65, a lateral slot 67 and a recess 69. Bore 63 is aligned with bore 59 and is adapted to receive the crossbar bar of a plastic fastener. Slot 65 is aligned with slot 61 and is adapted to permit the flexible filament of a fastener to pass therethrough while the cross-bar attached to the filament is seated in bore 63. Lateral slot 67 is used to permit a cross-bar to be loaded into base portion 55 from the side of base portion 55. Recess 69 is adapted to accommodate a needle locking shaft (not shown) of a plastic fastener dispensing tool.

Base portion 55 is also provided with a "V"-shaped cutting element or notch 71 along its rear surface, notch 71 being sized and shaped like notch 43 and being used to sever the severable connector extending between a fastener and its associated runner bar. Notch 71 suffers from the same types of problems as notch 43.

Figure 5:
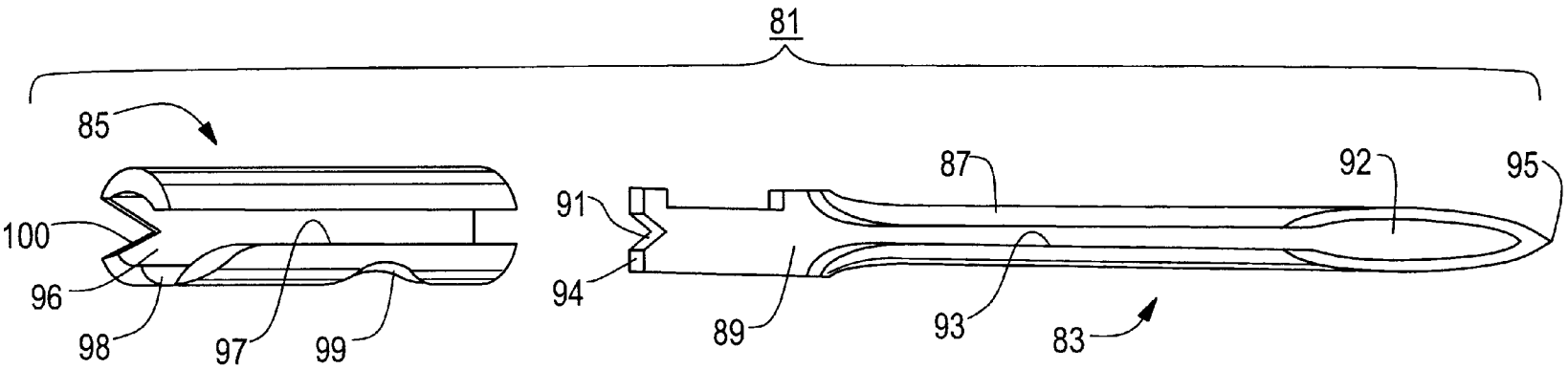
FIG. 5 PRIOR ART
FIG. 5 is an exploded top perspective view of a third conventional needle adapted for use in a plastic fastener dispensing tool.
Figure 6:
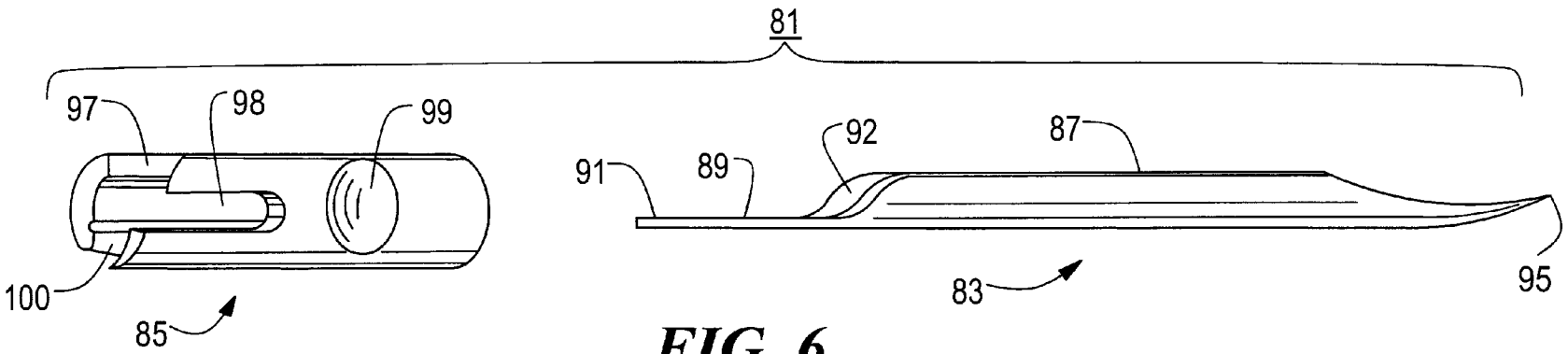
FIG. 6 PRIOR ART
FIG. 6 is an exploded side perspective view of the conventional needle of FIG. 5.
Figure 7:
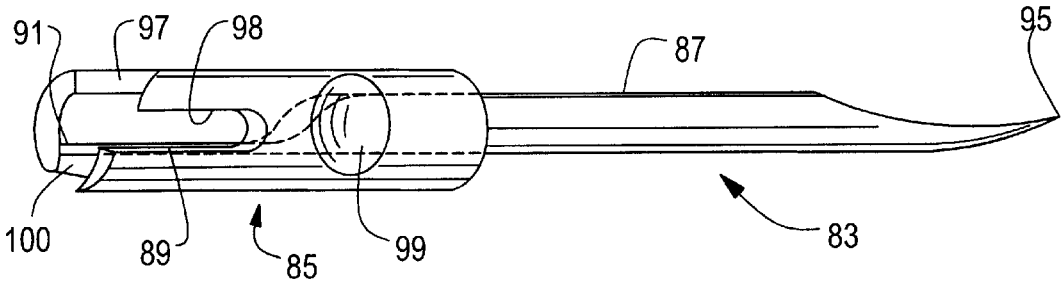
FIG. 7 PRIOR ART
FIG. 7 is a side perspective view of the conventional needle of FIG. 5.

Referring now to FIGS. 5 through 7, there are shown various views of a third conventional needle adapted for use in a plastic fastener dispensing tool, said needle being represented generally by reference numeral 81.

Needle 81, which is similar in its overall shape to needle 51, is a two-piece structure comprising a stem 83 and a base 85. Stem 83, which is typically made from stamped and rolled metal, has a front portion 87 and a rear portion 89. Front portion 87 is generally cylindrical in shape and has a longitudinal bore 92, a longitudinal slot 93 and a tip 95. Rear portion 89 of stem 83 is provided with a V-shaped cutting notch 91 along its rear edge 94 for use in severing the severable connector between a fastener and its runner bar, notch 91 being sized and shaped like notch 43. Notch 91 suffers from the same types of problems as notch 43.

Base 85, which is made of molded plastic, is mounted onto rear portion 89 of stem 83. Base 85 includes a longitudinal bore 96, a longitudinal slot 97, a lateral slot 98 and a recess 99. Bore 96 is aligned with bore 92 and is adapted to receive the cross-bar of a plastic fastener. Slot 97 is aligned with slot 93 and is adapted to permit the flexible filament of a fastener to pass therethrough while the cross-bar attached to the filament is seated in bore 92. Lateral slot 98 is used to permit a cross-bar to be loaded into base 85 from the side of base 85. Recess 99 is adapted to accommodate a needle locking shaft (not shown) of a plastic fastener dispensing tool.

Base 85 is also provided with a cutout 100 at the rear end thereof that is in alignment with notch 91 of stem 83 and which serves to prevent base 85 from interfering with the operation of notch 91.

Figure 8:
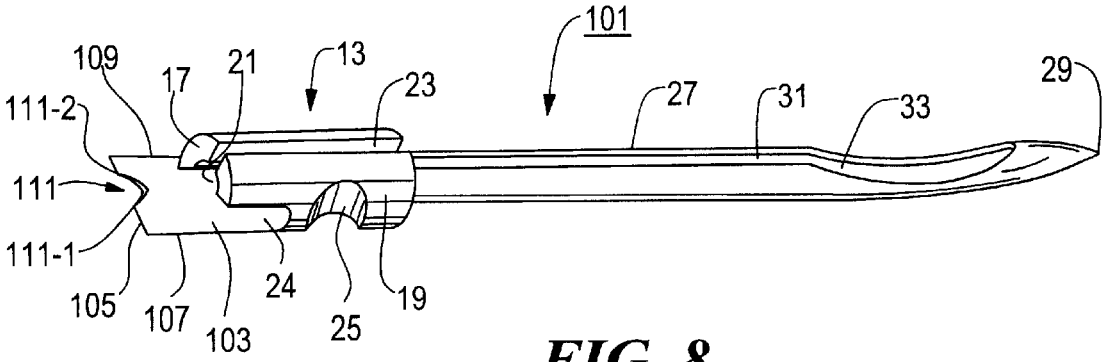
FIG. 8 is a top rear perspective view of a first embodiment of a needle constructed according to the teachings of the present invention for use in a plastic fastener dispensing tool.
Figure 9:
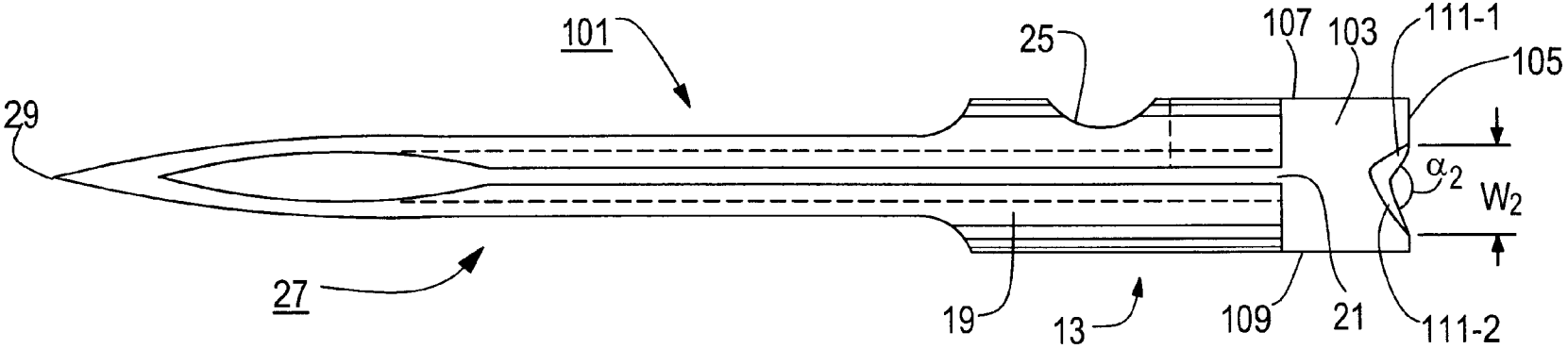
FIG. 9 is a top view of the needle of FIG. 8.

Referring now to FIG. 8 and 9, there are shown perspective and top views, respectively, of a first embodiment of a needle constructed according to the teachings of the present invention for use in a plastic fastener dispensing tool, said needle being represented generally by reference numeral 101.

Needle 101 is similar in most respects to needle 11, the principal difference between the two needles being that needle 101 includes a knife portion 103 instead of knife portion 35. Knife portion 103 includes a rear edge 105 and a pair of side edges 107 and 109. An asymmetric "V"-shaped cutting element or notch 111 extends partially across rear edge 105, notch 111 being adapted to receive the severable connector extending between a fastener and its associated runner bar and to sever said connector as the cross-bar of the fastener is pushed through needle 101. Notch 111, which is defined by a short edge 111-1 and a long edge 111-2, has an internal angle $\alpha_2$ of approximately 110° and a width $w_2$ of approximately 0.050–0.055 inch. (Knife portion 103 has a width of approximately 0.1 inch.) The vertex of notch 111 is positioned along the centerline of knife portion 103, with short edge 111-1 being proximate to lateral slot 24 and long edge 111-2 being distal to lateral slot 24. Because of the elongation of notch 111 in the direction of edge 111-2, when a cross-bar is fed into base portion 13 through slot 24, if it is advanced past the centerline of knife portion 103, it is likely that its severable connector will still be positioned somewhere within notch 111.

Figure 10:
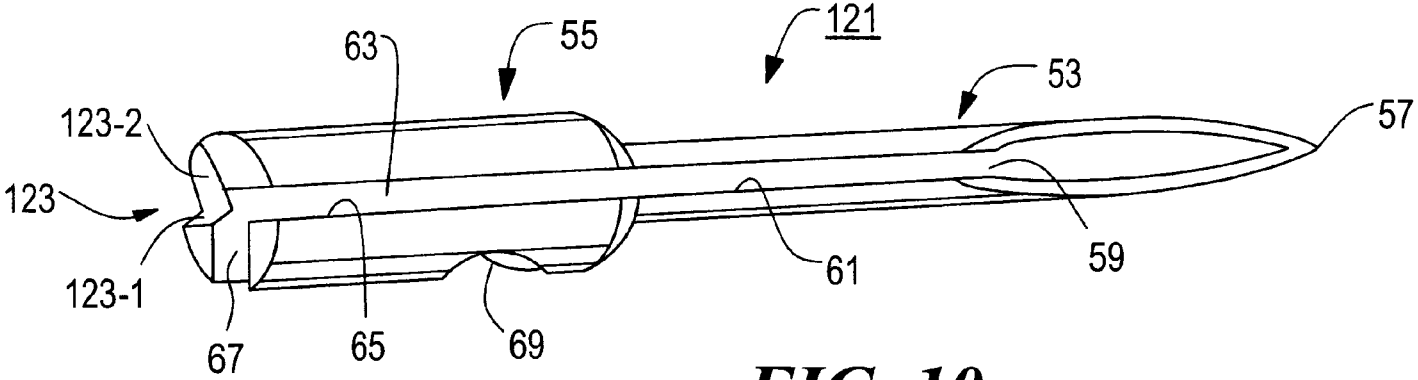
FIG. 10 is a top perspective view of a second embodiment of a needle constructed according to the teachings of the present invention for use in a plastic fastener dispensing tool.

Referring now to FIG. 10, there is shown a top perspective view of a second embodiment of a needle constructed according to the teachings of the present invention for use in a plastic fastener dispensing tool, said needle being represented generally by reference numeral 121.

Needle 121 is identical in most respects to needle 51, the principal difference between the two needles being that needle 121 includes a notch 123 instead of notch 71. Notch 123, which extends partially across the rear surface of base portion 55, is identical in size and shape to notch 111. The vertex of notch 123 is positioned along the centerline of base portion 55, with the short edge 123-1 of notch 123 being proximate to lateral slot 67 and the long edge 123-2 of notch 123 being distal to lateral slot 67. As can be seen, notch 123 shares the same types of advantages as notch 111.

Figure 11:
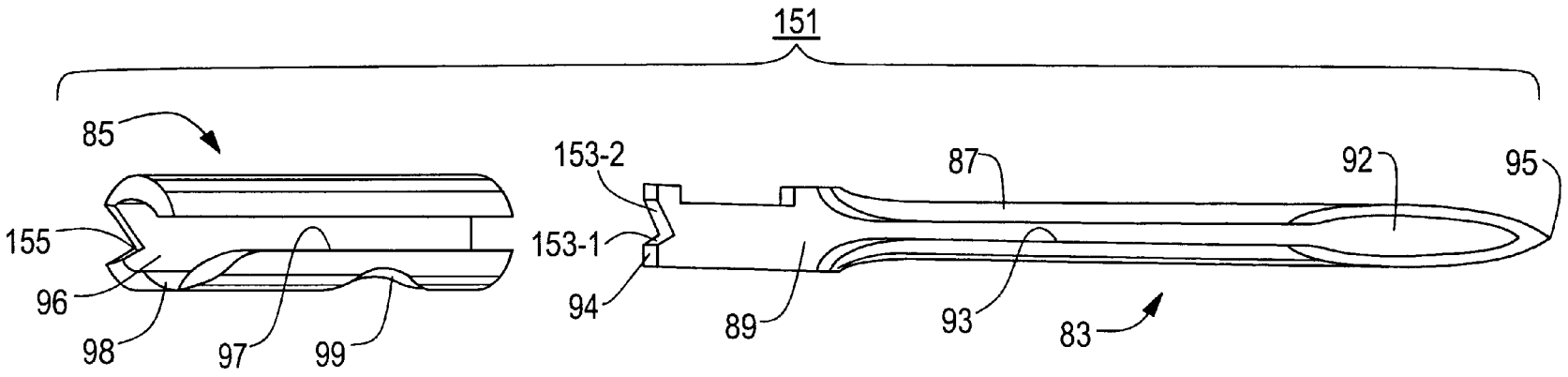
FIG. 11 is an exploded top perspective view of a third embodiment of a needle constructed according to the teachings of the present invention for use in a plastic fastener dispensing tool.

Referring now to FIG. 11, there is shown an exploded top perspective view of a third embodiment of a needle constructed according to the teachings of the present invention for use in a plastic fastener dispensing tool, said needle being represented generally by reference numeral 151. Needle 151 is identical in most respects to needle 81, the principal difference between the two needles being that needle 151 includes a notch 153 instead of notch 91. Notch 153, which extends partially across rear edge 94 of stem 83, is identical in size and shape to notch 111. The vertex of notch 153 is positioned along the centerline of stem 83, with the short edge 153-1 of notch 153 being on the same side of the centerline as lateral slot 98 and the long edge 153-2 of notch 153 being on the opposite side of the centerline as lateral slot 98. As can be seen, notch 153 shares the same types of advantages as notch 111.

Another difference between needles 81 and 151 is that base 85 of needle 151 has a cutout 155 that is sized and shaped appropriately for notch 151.

Figure 12:
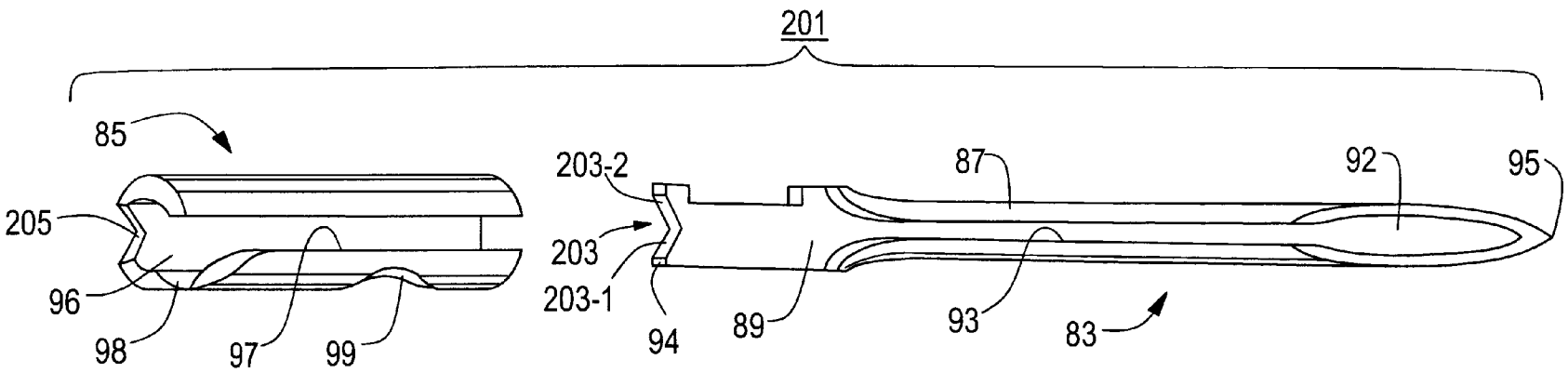
FIG. 12 is an exploded top perspective view of a fourth embodiment of a needle constructed according to the teachings of the present invention for use in a plastic fastener dispensing tool.

Referring now to FIG. 12, there is shown an exploded top perspective view of a fourth embodiment of a needle constructed according to the teachings of the present invention for use in a plastic fastener dispensing tool, said needle being represented generally by reference numeral 201.

Needle 201 is identical in most respects to needle 151, the principal difference between the two needles being that needle 201 includes a notch 203 instead of notch 153. (Needle 201 also includes a cutout 205 sized and shaped for notch 203.) Notch 203, which extends partially across rear edge 94 of stem 83, is a symmetric "V"-shaped notch. The vertex of notch 203 is positioned along the centerline of stem 83, with the two edges 203-1 and 203-2 of notch 203 being a mirror image of and identical to, respectively, the long edge 153-2 of notch 153. Consequently, notch 203 has an internal angle of approximately 145° and a width of approximately 0.08 inch. However, despite its differences with notch 153, notch 203 can be seen to share many of the same types of advantages as notch 153.

As can readily be appreciated, needles 101 and 121 could be modified so as to include a notch having the size and shape of notch 203.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A needle for use in a plastic fastener dispensing tool, said needle comprising:

(a) a stem, said stem being elongated and having a front portion and a rear portion, said front portion being shaped to include a slotted longitudinal bore terminating in a tip at its front end, said rear portion having a knife implement in the form of a notch at its rear end, said notch having an internal angle of approximately 110 degrees and being asymmetric about the longitudinal axis of said slotted longitudinal bore, said notch extending only partially across the rear end of said rear portion of said stem; and (b) a base, said base being mounted onto said rear portion of said stem, said base being shaped to include a slotted longitudinal bore aligned with said slotted longitudinal bore of said stem.

2. The needle as claimed in claim 1 wherein said notch has a width of approximately 0.050–0.055 inch.

3. The needle as claimed in claim 1 wherein said notch has a vertex, said vertex being centered within said knife implement.

4. The needle as claimed in claim 1 wherein said base is further shaped to include a lateral slot adapted to permit a cross-bar of a fastener to be loaded into said base from the side thereof.

5. The needle as claimed in claim 4 wherein said notch has a long edge and a short edge and wherein said short edge is closer to said lateral slot than said long edge is to said lateral slot.

6. The needle as claimed in claim 1 wherein said notch is generally "V"-shaped.

7. A needle for use in a plastic fastener dispensing tool, said needle comprising:

(a) a stem, said stem being elongated and having a front portion and a rear portion, said front portion being shaped to include a slotted longitudinal bore terminating in a tip at its front end, said rear portion having a rear end, said rear end being shaped to include a knife implement in the form of a notch, said notch extending only partially across said rear end, said notch having an internal angle of approximately 110–145 degrees; and (b) a base, said base being mounted onto said rear portion of said stem, said base being shaped to include a slotted longitudinal bore aligned with said slotted longitudinal bore of said stem.

8. The needle as claimed in claim 7 wherein said notch has an internal angle of approximately 110 degrees.

9. The needle as claimed in claim 8 wherein said notch is asymmetric about the longitudinal axis of said slotted longitudinal bore of said stem.

10. The needle as claimed in claim 8 wherein said base is further shaped to include a lateral slot adapted to permit a cross-bar of a fastener to be loaded into said base from the side thereof.

11. The needle as claimed in claim 10 wherein said notch has a long edge and a short edge and wherein said short edge is closer to said lateral slot than said long edge is to said lateral slot.

12. The needle as claimed in claim 7 wherein said notch has an internal angle of approximately 145 degrees.

13. The needle as claimed in claim 9 wherein said notch is generally "V"-shaped and wherein said notch has a vertex, said vertex being centered within said knife implement.

14. A needle for use in a plastic fastener dispensing tool, said needle comprising:

(a) a stem, said stem being elongated and having a front portion and a rear portion, said front portion being shaped to include a slotted longitudinal bore terminating in a tip at its front end, said rear portion having a rear end, said rear end being shaped to include a knife implement in the form of a notch, said notch having a width of approximately 0.05–0.08 inch, said notch extending only partially across said rear end of said rear portion of said stem, said notch having a vertex, said vertex being centered within said knife implement; and (b) a base, said base being mounted onto said rear portion of said stem, said base being shaped to include a slotted longitudinal bore aligned with said slotted longitudinal bore of said stem.

15. The needle as claimed in claim 14 wherein said notch has a width of approximately 0.050–0.055 inch.

16. The needle as claimed in claim 15 wherein said notch is asymmetric about the longitudinal axis of said slotted longitudinal bore of said stem.

17. The needle as claimed in claim 16 wherein said base is further shaped to include a lateral slot adapted to permit a cross-bar of a fastener to be loaded into said base from the side thereof and wherein said notch has a long edge and a short edge, said short edge being closer to said lateral slot than said long edge is to said lateral slot.

18. The needle as claimed in claim 14 wherein said notch has a width of approximately 0.08 inch.

19. The needle as claimed in claim 18 wherein said notch is generally "V"-shaped.

20. A needle for use in a plastic fastener dispensing tool, said needle comprising:

(a) a stem, said stem being elongated and having a front portion and a rear portion, said front portion being shaped to include a slotted longitudinal bore terminating in a tip at its front end, said rear portion having a knife implement in the form of a notch at its rear end, said notch being asymmetric about the longitudinal axis of said slotted longitudinal bore, said notch having a vertex, said vertex being centered within said knife implement; and (b) a base, said base being mounted onto said rear portion of said stem, said base being shaped to include a slotted longitudinal bore aligned with said slotted longitudinal bore of said stem.

21. The needle as claimed in claim 20 wherein said notch extends only partially across the rear end of said rear portion of said stem.

* * * * *